US005924151A

United States Patent [19]

Connan

[11] Patent Number: 5,924,151

[45] Date of Patent: Jul. 20, 1999

[54] DISPENSER WITH ENHANCED DIFFUSION

[75] Inventor: Patrick Andre Connan, Lebanon, N.J.

[73] Assignee: Colgate-Palmolive, New York, N.Y.

[21] Appl. No.: 08/761,048

[22] Filed: Dec. 5, 1996

Related U.S. Application Data

[63] Continuation-in-part of application No. 08/680,939, Jul. 15, 1996

[60] Provisional application No. 60/001,991, Aug. 7, 1995.

[51] Int. Cl.[6] ..... D06F 39/02

[52] U.S. Cl. ..... 8/158; 68/17 R; 206/0.5; 222/209

[58] Field of Search ..... 68/17 R; 206/0.5; 222/209, 212; 99/287; 426/80; 8/158

[56] References Cited

U.S. PATENT DOCUMENTS

| | | | |
|---|---|---|---|
| 3,156,383 | 11/1964 | Melli | 222/212 X |
| 3,240,567 | 3/1966 | Caparreli et al. | 206/0.5 X |
| 4,703,872 | 11/1987 | Cornette et al. . | |

FOREIGN PATENT DOCUMENTS

| | | | |
|---|---|---|---|
| 237759 | 12/1959 | Australia | 222/212 |
| 13548/88 | 3/1988 | Australia . | |
| 182095 | 5/1955 | Austria | 68/213 |
| 0 327 716 | 8/1989 | European Pat. Off. . | |
| 0 343 069 | 11/1989 | European Pat. Off. . | |
| 2 612 894 | 9/1988 | France . | |
| 2 244 722 | 12/1991 | United Kingdom . | |

OTHER PUBLICATIONS

PCT Search Report.

*Primary Examiner*—Philip R. Coe
*Attorney, Agent, or Firm*—Michael McGreal

[57] ABSTRACT

This invention relates to a device for providing a dose of a liquid or solid to a larger container. More particularly, this invention relates to a dispensing device for providing a dose of substances, such as solid or liquid detergents or bleaches to a wash tub. This is accomplished by the structure of the doser device which provides for an increase and decrease in the volume of the doser during use. In a preferred embodiment, the structure to increase and decrease the volume of the dispenser is one or more bellows which are a part of the surface of the doser.

14 Claims, 5 Drawing Sheets

DISPENSER WITH ENHANCED DIFFUSION

This is a continuation-in-part of U.S. Ser. No. 08/680,939 filed Jul. 15, 1996, and now abandoned and a provisional of 60/001,991 filed Aug. 7, 1995.

BACKGROUND OF THE INVENTION

This invention relates to a device for providing a dose of a liquid or solid to a larger container. More particularly, this invention relates to a dispensing device for providing a dose of substances, such as active agents, to a wash tub.

The treatment of fibers, fabrics and laundry with substances, such as cleaning and bleaching agents, to improve the cleanliness and appearance of such treated materials is a well known operation. It has become customary to introduce a quantity of substances into the wash water in the usual washing of fabrics in an automatic washing machine. In some instances predetermined amounts of the substances are packaged in water soluble packets that are thrown into the wash water with the fabrics, and in some instances the machine operator pours the substances directly into the wash water from a container according to directions. In both these instances the substances may remain concentrated in one region of the wash water, and to overcome this problem it has become known to place the substances in a doser device within the wash water to gradually dispense the substances into the agitated wash water currents as fabrics are being washed.

Doser devices are of various shapes and have various sized openings for the dispensing of the substances. Some doser devices have perforated casings which are designed to contain the substances until the first few turns of the drum. U.S. Pat. No. 4,014,105 discloses the use of a doser device containing a conditioning liquid, such as fabric softener and/or anti-static agents, which is put into an automatic dryer and is tumbled with laundry being conditioned in the automatic dryer. The doser discharges the solution of conditioning agent through perforations in the container, so that the agent is applied to the laundry and conditions it. Similarly, U.S. Pat. No. 4,703,872 No. (a counterpart of French Patent No. 2,570,720 and EP 0152,359B2), U.S. Pat. No. 4,874,107 (a counterpart of EP 028B,345B1) and U.S. Pat. No. 3,400,808 provide various sized openings in the doser device to distribute the contents of the device, usually a liquid detergent, during a washing cycle. These doser devices are mainly directed for use with liquid detergents and have comparatively large dispensing openings. The contained liquid detergent is released very rapidly.

The evolution of detergent formulae is towards an increasing concentration of the substances. Further, there is an increased use of solid bleaches. The use of such detergents and solid bleaches leads to the danger of staining or discoloring fabrics and particularly when such fabrics come into contact with undissolved solid particles of these substances. The substances from the doser device should not contact any fabrics until fully dissolved. The substances preferably should remain in the doser until dissolved. The existing dispensing devices do not prevent the possibility of fabrics coming into contact with the substances in a highly concentrated condition and which thus possibly stain or discolor the fabric. The problem of the prior art that the present invention overcomes is the potential for staining and/or discoloration if a solution or agent, such as a bleaching agent or concentrated laundry detergent, comes into contact with the fabric before any significant dilution by the wash water. The staining and/or discoloration is due to the expulsion of the agent onto the fabric when it is in a high concentration.

The present invention overcomes these problems through the exchange of the substances in the doser device and liquid from the wash tub. This is accomplished by the structure of the doser device which provides for an increase and decrease in the volume of the doser during its use in a wash tub. In a preferred embodiment, the structure to increase and decrease the volume of the dispenser is a bellows arrangement in one or more surfaces of the closer. The turning of the drum of a washing machine causes the substances in the doser device to enter the wash water as liquids. The substances in a decreased concentration then contact the fabrics to be washed. The doser devices of the present invention are durable but flexible, and have small apertures so as to contain a powder or concentrated liquid active inside the doser device and only allow the passage of dissolved solid substances and lower concentration liquids into the wash tub, thereby preventing the chance of staining and/or discoloration of the fabric in the laundry.

BRIEF DESCRIPTION OF THE INVENTION

The present invention is directed to an inexpensive, reusable doser device which is comprised of a hollow body of novel construction for the reliable metered dispensing of substances such as powder additives and solid and liquid detergents uniformly over a period of time into the wash water in an automatic washing machine. This doser device is particularly useful with bleach powders and concentrated powder detergents.

The hollow body can be filled with at least one substance which is released on contact with a liquid medium. The hollow body has a main chamber portion, a neck on this main chamber portion defining a mouth and a cover over the mouth. Also integral with the hollow body is a means to increase and decrease the volume of the hollow body during use, and in a preferred embodiment a bellows arrangement is built into the walls of the hollow body as the means to increase and decrease the volume of the device. The bellows allow the volume of the hollow body to contract and expand in a given range during the operation of a washing machine. This change in volume functions to create a pumping action and increases the liquid exchange between the liquid in the main chamber and liquid medium in a wash tub, and thus favors a fast dissolution of the substances.

In addition, a portion of the hollow body, and usually a cover, has an area with a plurality of small apertures. This plurality of apertures can be formed by a plurality of fine apertures or mesh and in one embodiment in the form of a woven or non woven material. In another embodiment it can be a sheet of open celled foam. It can also be a sheet with a plurality of small diameter apertures. A woven or non-woven material can be of a natural or artificial fiber. The size of the apertures generally are less than about 100 $\mu$. A supporting and protecting grid overlays and protects the fine mesh openings from damage and separates the laundry from the fine mesh. The grid pieces of this protecting section preferably are connected to provide greater strength. In any form the fine mesh section essentially prevents any undissolved particles or undiluted liquid from exiting the main chamber of the dispensing device. The fine mesh section usually will be protected from direct contact with the surrounding washed fabrics, and any damage in use, by the protecting grid. This protecting grid can be of essentially any shape or form, as long as it functions to protect the fine mesh section and to keep the fabric separated from the fine mesh section. Suitable shapes are intersecting grid pieces, concentric circular or elliptical pieces, or random grid pieces. The fine mesh section can be permanently or removably affixed to the dispensing device. It can be affixed to the hollow body or hollow body cover by means of adhesives, direct sealing or mechanically. The hollow body cover can be hingedly attached to the hollow body or removably attached by threads or cooperating rib and groove arrangements. The user can open or remove a cover of the hollow body to fill the hollow body with the desired substance and then close and secure the cover to prevent an unintentional opening of the cover during washing machine use.

The hollow body can be made from any resilient plastic. This includes plastics such as polyethylene or polypropylene, which are sufficiently heat stable at the temperatures of operation to maintain its original form, while allowing some temporary distortions during tumbling in a washing machine. These distortions result in a change in volume which helps to facilitate dispensing of the substances in the hollow body. However, the device is resilient enough to recover its shape when outside forces cease distorting the shape of the hollow body. The dimension of this hollow body is usually between 5 to 15 cm in diameter but can be larger or smaller in diameter.

In a preferred embodiment of the present invention there is provided a hollow body having enhanced diffusion by means of one or more bellows integral with the hollow body structure so that the hollow body can contract and expand to allow the substances in the hollow body to exchange with the water in the wash tub prior to leaving the doser. This avoids prolonged contact of the fabric with the substances in a concentrated condition, thereby reducing the chances of discoloration and staining of the fabrics in the wash.

DETAILED DESCRIPTION OF THE INVENTION

The present invention will be described in more detail with reference to the accompanying drawings.

Figure 1:
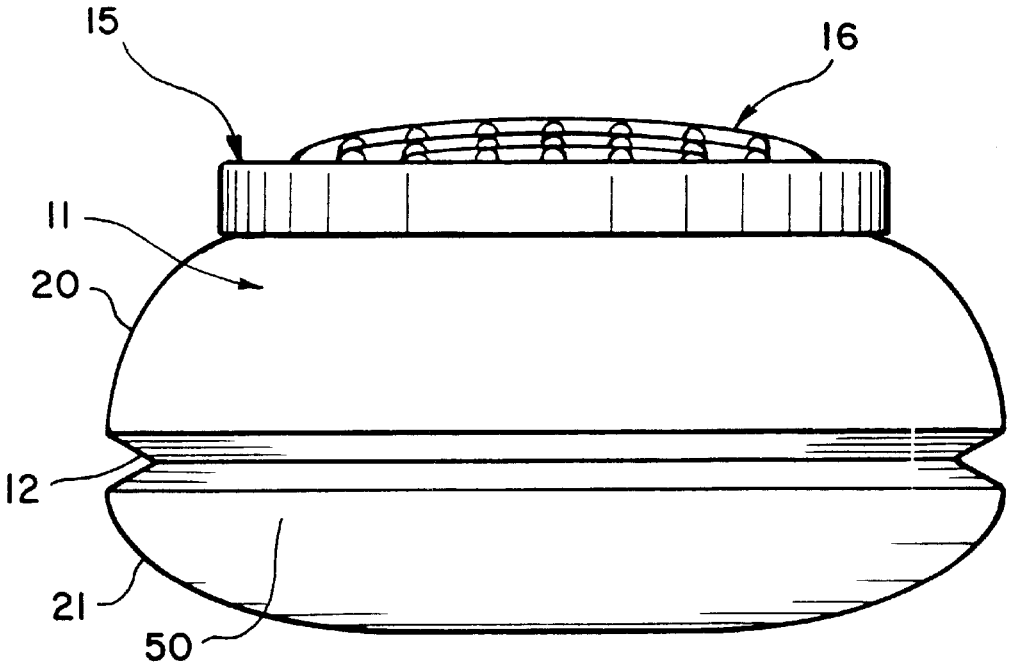
FIG. 1 is a side elevational view of the hollow body of the present invention, illustrating bellows integral with the hollow body and with the cover closed.

As shown in FIG. 1, the hollow body 11, has an outer surface 50 and comprises hemispherical portions 20 and 21. Bellow 12 is in the surface 50 of the hollow body and is intermediate the two hemispherical portions. The hollow body 11 is preferably a resilient plastic which is sufficiently heat stable at the temperatures of operation in a washing machine to maintain the generally spherical form, while allowing some temporary distortions during tumbling in a washing machine. This causes a change in the volume of the hollow body which in turn helps to facilitate dispensing of the substances. The bellow provides for a pumping action. The bellow 12, which is integral with the closure of the hollow body 11, allows the volume of the hollow body 11 to contract and expand in a given range to create a pumping action, thereby increasing the liquid exchange between the interior of the hollow body 11 and the liquid medium outside the hollow body 11.

The upper hemisphere of the hollow body has a neck 13 with a dispensing closure 15 attached to the neck. Here the closure carries the means for the exchange of the substance in the hollow body to the exterior of the hollow body. However, the closure need not be a dispensing closure and may be a continuous section of plastic. In such a case another portion of the hollow body would carry the means for the exchange of the substance within the hollow body to the exterior of the hollow body. This could be surface 50 or the bottom surface of the hollow body.

Figure 2:
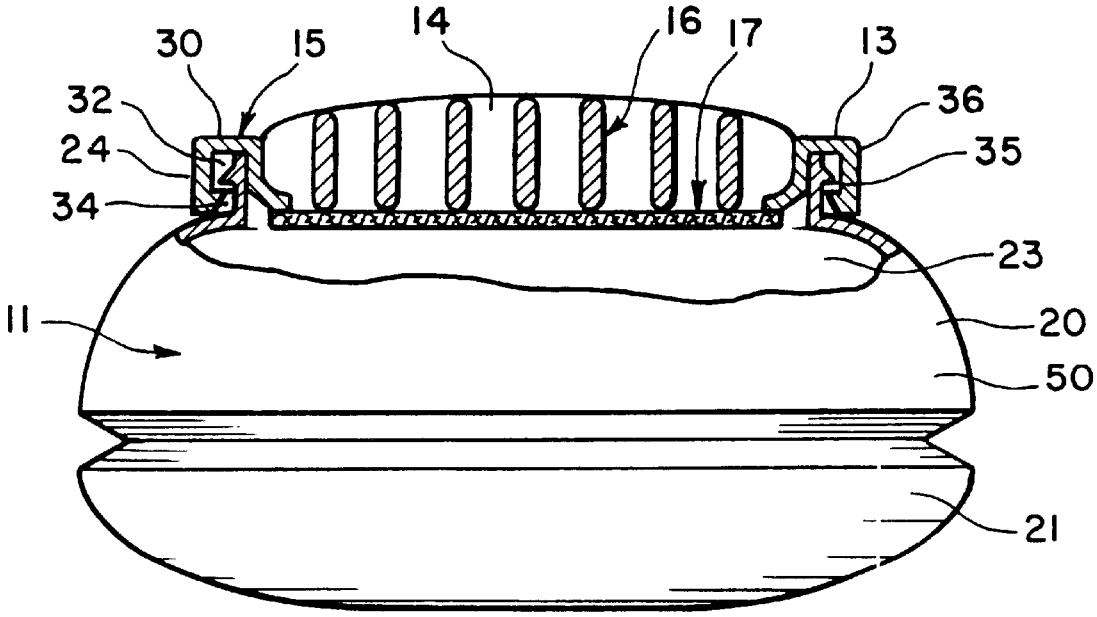
FIG. 2 is a partial cross-sectional view of the hollow body of FIG. 1.

There is shown in FIG. 2, a cross-sectional view of the hollow body 11. In this embodiment, the means to exchange the substances in the hollow body to the exterior is a part of the closure. There is an inner chamber 23 and a mouth 14 which is covered by a dispensing closure 15. The dispensing closure has a large mesh protecting grid 16. The dispensing closure couples to the neck 13 of the hollow body by a suitable fastening means. One such fastening means consists of an interlocking projecting rib and mating recess arrangement. The hollow body has a projecting rib 32 extending from the outer wall of the neck. This projecting rib 32 couples with a cooperating recess 34 on the skirt 36 of the dispensing closure. Projection 35 forms the lower part of the recess Skirt 36 depends from flange 30. Projections 32 and 35 are beveled on the surfaces which contact when the dispensing closure is being put onto the hollow body and slide past each other to then interlock. This bevel is for ease of assembly. In addition, the dispensing closure can be attached to the hollow body by a hinge, by mating threads or by cooperating rib and groove arrangements. Adjacent the protecting grid 16, there is a fine mesh grid 17. The fine mesh section 17 can be permanently or removably fixed to the dispensing closure of the dispensing device. The fine mesh grid 17 usually will be affixed to the dispensing closure by means, of adhesives, direct heat sealing or mechanically by being sandwiched between two support members.

In this view the protecting grid 16 is shown as overlaying and contacting fine mesh section 17. This can range from contacting to a spaced relationship of up to about 1 cm, and preferably up to about 0.5 cm. The objective of the protecting grid is to space materials being treated from the fine mesh section so that the substances from the hollow body are more effectively diluted before contacting any fabrics and to protect the fine mesh section from damage.

Figure 3:
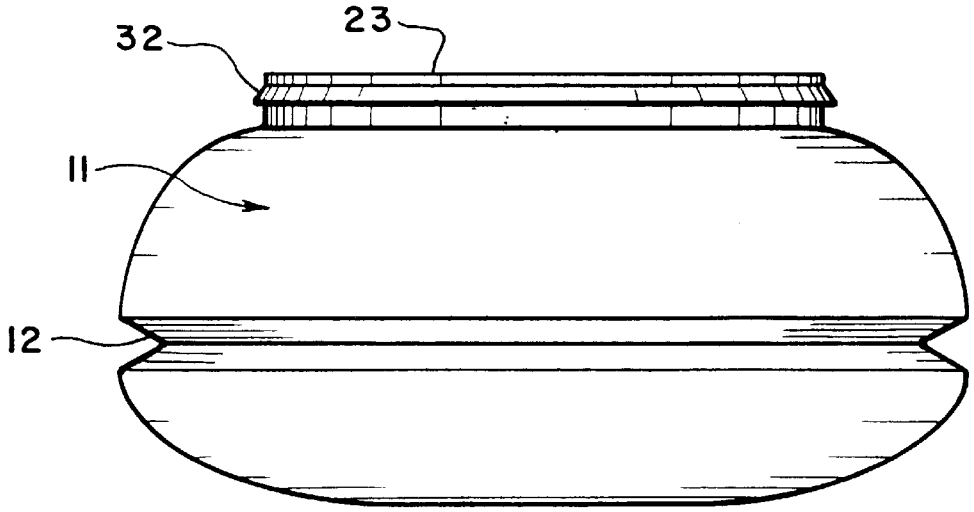
FIG. 3 is a side elevational view of a hollow body of the present invention, illustrating bellows integral with the hollow body with the cover removed for filling with a substance.

There is shown in FIG. 3, a hollow body 11 without the dispensing closure which shows the opening where the substance can be added to the inner chamber 23 of the hollow body. The user can open the dispensing closure of the hollow body to fill the hollow body with the desired substance and then close and secure the dispensing closure onto the hollow body to prevent an unintentional opening of the dispensing closure before or during washing machine use.

Figure 4:
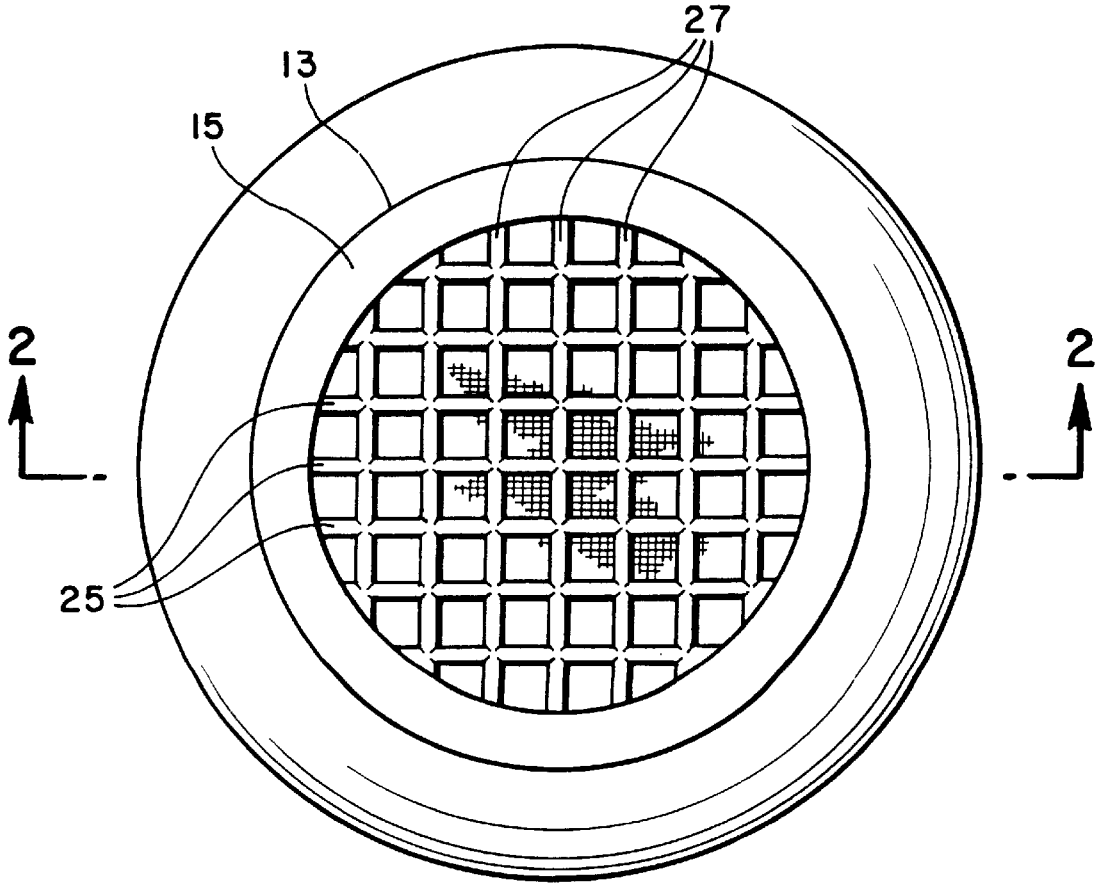
FIG. 4 is a top plan view of an hollow body showing the structure of a cover.

There is shown in FIG. 4, a top plan view of the hollow body and in particular the dispensing closure. At plurality of apertures is formed by the fine mesh 17. This fine mesh section can be a sheet with a plurality of apertures or can be made of a woven or non-woven material. It also can be an open cell foam material. The protecting large mesh grid in this embodiment has horizontal support pieces 25 and vertical support grid pieces 27. The dimensions of the apertures of the protecting grid must prevent the contact between fabrics and the fine mesh. In either the woven or non-woven form the fine mesh 17 essentially prevents any undissolved particles or undiluted liquid from exiting the inner chamber 23 of the hollow body during use. The grid pieces 25 and 27 protect the fine mesh grid from direct contact with the surrounding fabrics being washed and provide for further dilution with wash water prior to contact with the fabrics. An alternative embodiment for the grid pieces 25 and 27 include preferably intersecting grid pieces, which do not necessarily have to be horizontal and vertical. These can be in a concentric circular or elliptical arrangement, a wave or random pattern or any other arrangement that will keep the fabrics being washed separated from the fine mesh and protect the fine mesh grid from damage.

Figure 5:
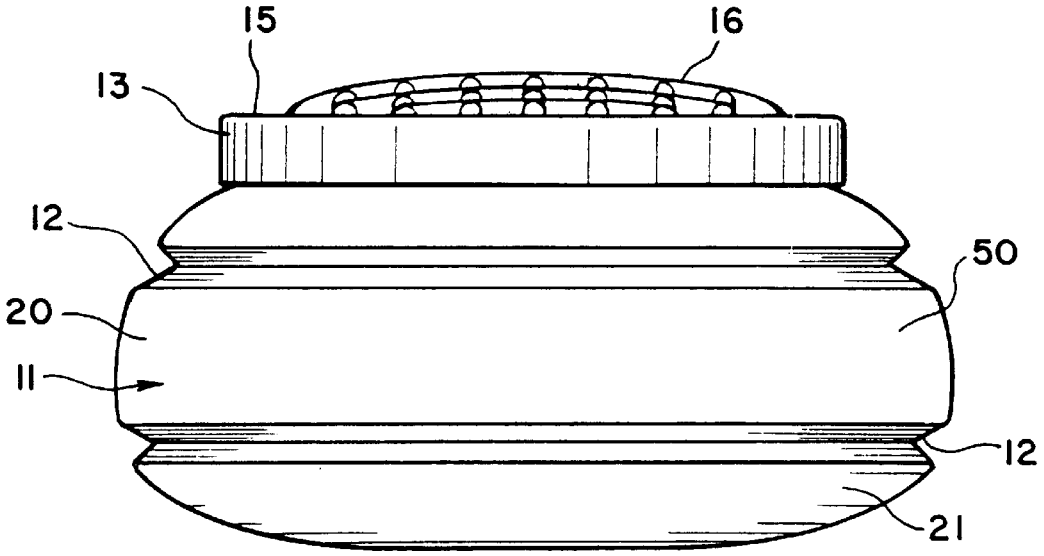
FIG. 5 is a cross-sectional view of a hollow body having two bellows.

In FIG. 5, there is shown a dispenser where the hollow body has two sets of bellows 12 which allow a greater volume of the hollow body to contract and expand. The net result is a greater pumping action. The remainder of this dispenser is as described for the dispenser of FIG. 1.

FIGS. 6–9 are examples of alternative embodiments that may be used to construct the hollow body having at least one bellow.

Figure 6:
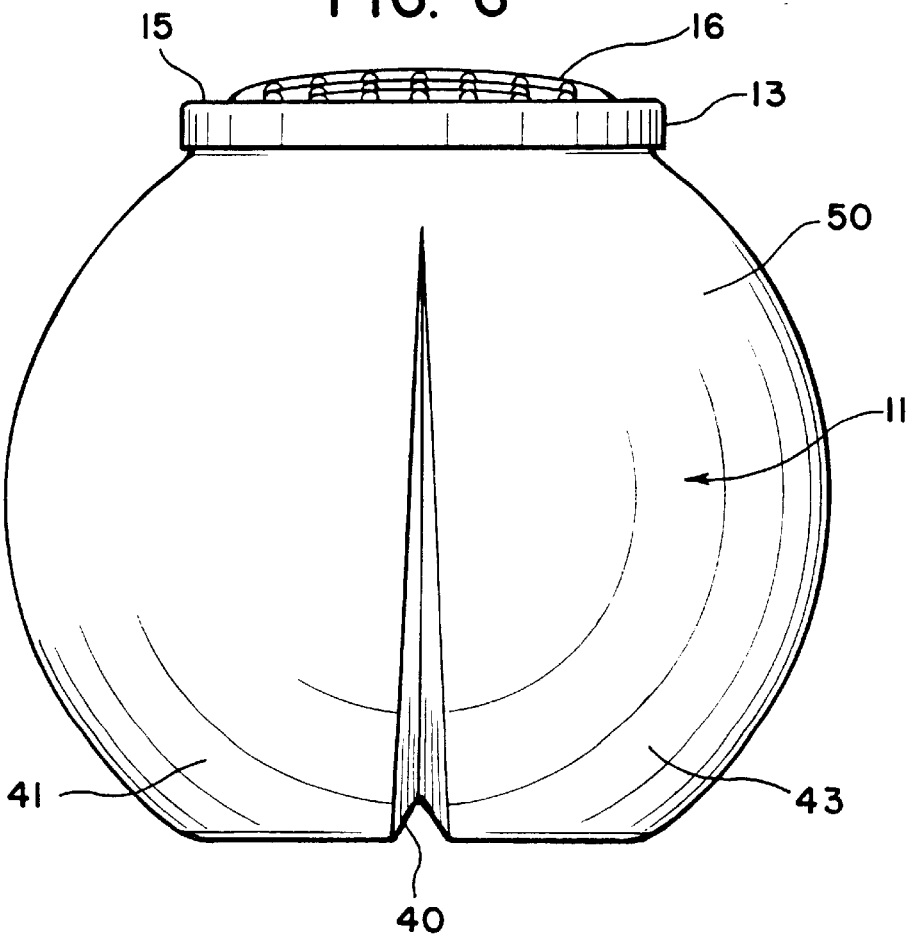
FIG. 6 is a side elevational view of the hollow body of the present invention, illustrating one vertical bellow integral with the hollow body with the cover closed.

In FIG. 6, there is shown a dispenser where the hollow body has one vertical bellow 40. The bellow of this embodiment is tapered near the top of the bellow and broadens to the bottom of the bellow. The bellow divides the surfaces of the hollow body into portions 41 and 43 The remainder of this dispenser is as described for the dispenser of FIG. 1. This provides for greater flex at the bottom and will enhance the pumping action of the hollow body and thus the delivery of the substances from the hollow body.

Figure 7:
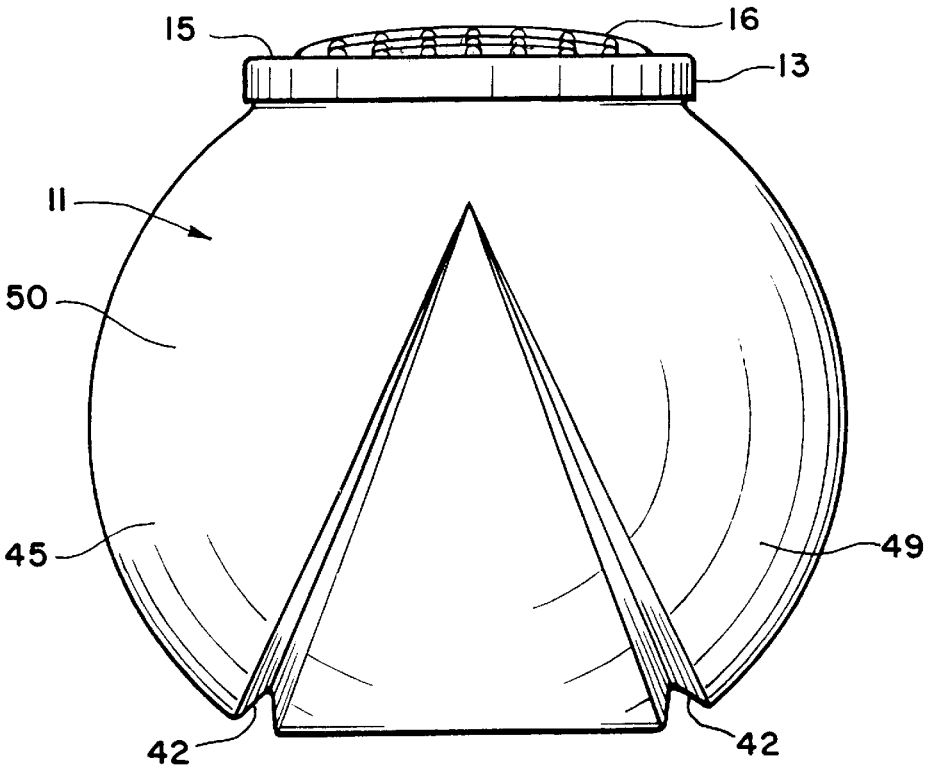
FIG. 7 is a side elevational view of the hollow body of the present invention, illustrating two bellows at an angle to the vertical axis integral with the hollow body with the cover closed.

In FIG. 7, there is shown a dispenser where the hollow body has two bellows 42 at an angle to the vertical axis of the hollow body. The angle can vary from about 10° to about 80°. The bellows of this embodiment are tapered near the top of the bellow and broaden at the bottom of the bellow similar to the bellow of FIG. 6. The bellows divide the surface of the hollow body into portions 45, 47, and 49. The remainder of this dispenser is as described for the dispenser of FIG. 1.

Figure 8:
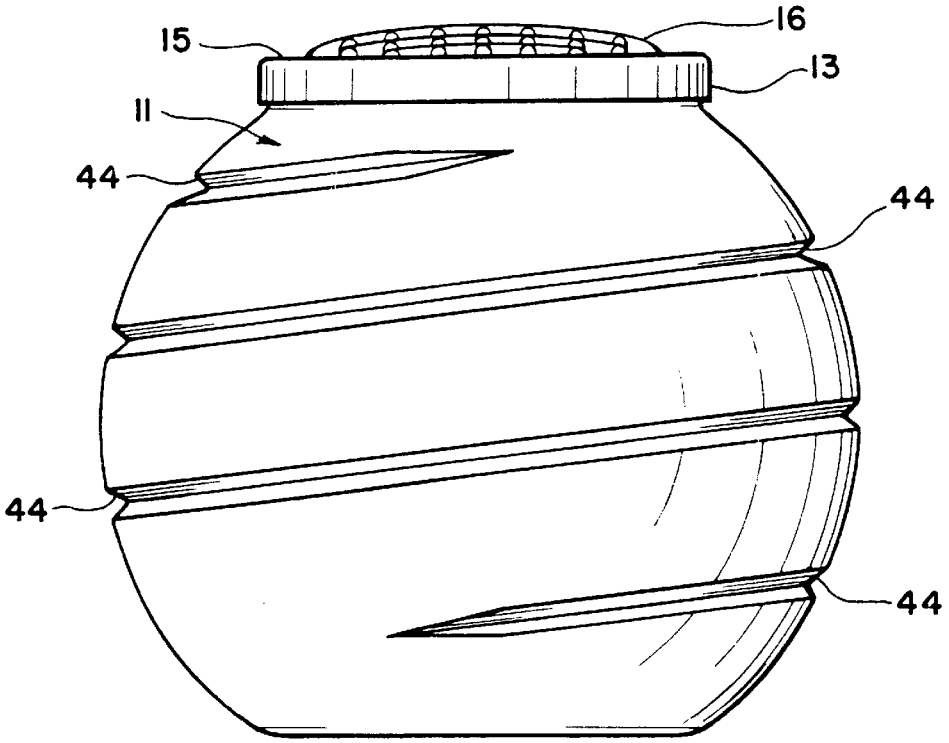
FIG. 8 is a side elevational view of the hollow body of the present invention, illustrating spiral bellows shown from the bottom to the top portion of the hollow body with the cover closed.

In FIG. 8, there is shown a dispenser where the hollow body has spiral bellow 44. The bellow is shown from the bottom to the top portion of the hollow body. However, the bellow may be a part of a smaller portion of the hollow body. The remainder of this dispenser is as described for the dispenser of FIG. 1.

Figure 9:
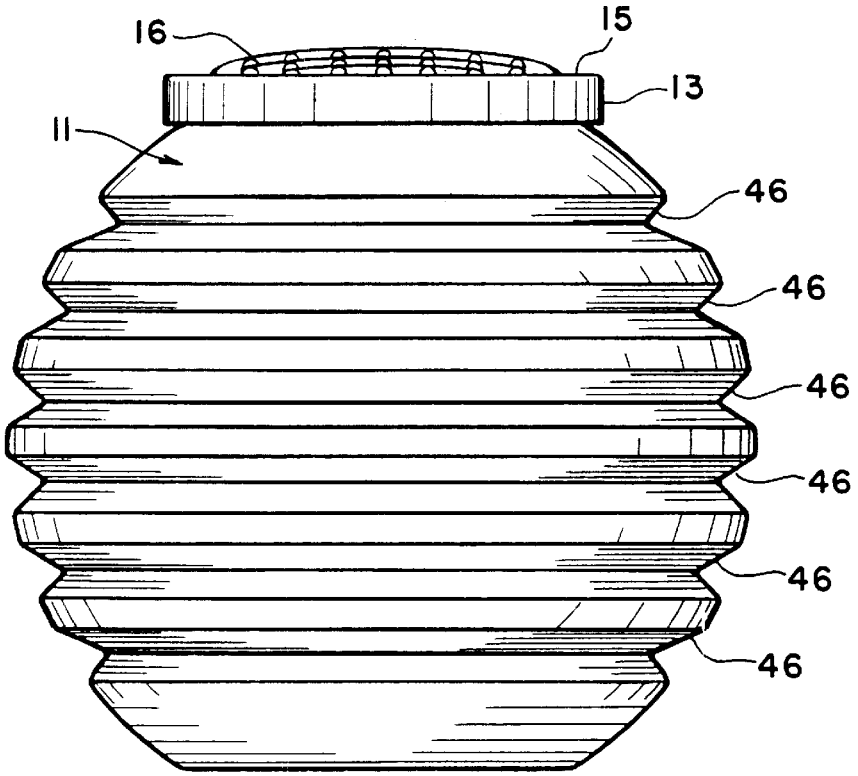
FIG. 9 is a side elevational view of the hollow body of the present invention, illustrating a plurality of bellows integral with the hollow body and with the cover closed.

In FIG. 9, there is shown a dispenser where the hollow body has a plurality of bellows 46. As shown this can be collapsed to a smaller size for storage. There can be more or fewer bellows than as shown in FIG. 9. The remainder of this dispenser is as described for the dispenser of FIG. 1.

Figure 10:
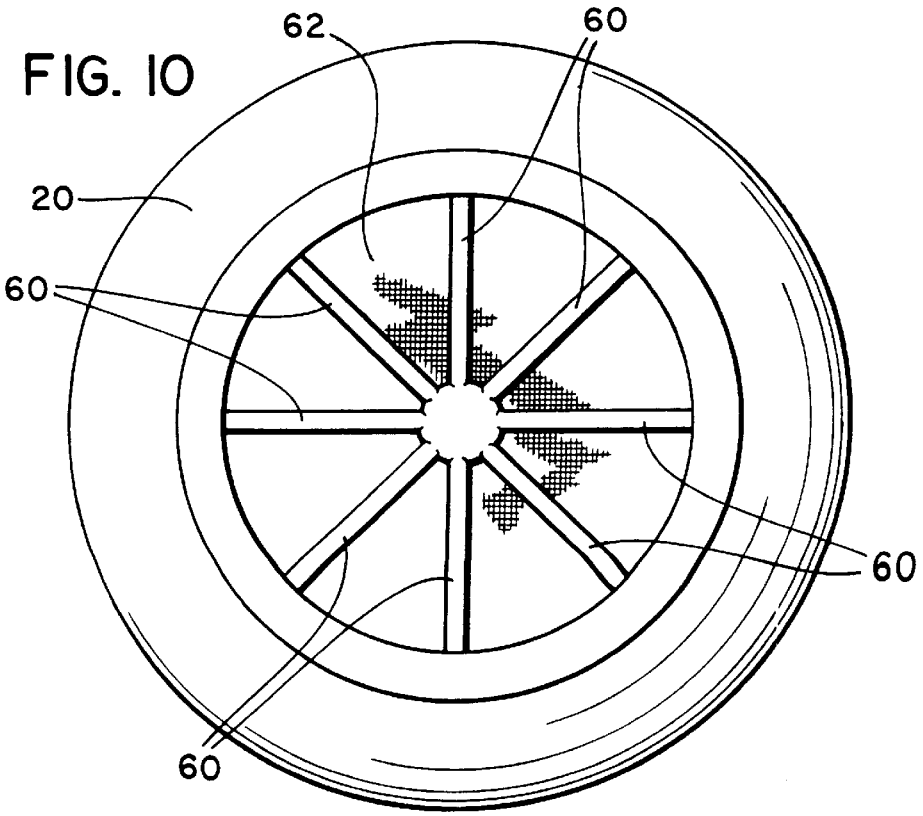
FIG. 10 is a top plan view of an hollow body showing an alternative embodiment of the structure of the cover.

In FIG. 10, there is shown a top plan view of the hollow body and in particular an alternative embodiment of the dispensing closure of FIG. 4. As in FIG. 4, a plurality of apertures is formed by the fine mesh 17 made of woven or non-woven material. However, in FIG. 10 the protecting grid pieces are arranged differently. The protecting large mesh grid has grid pieces 60 in a radial spoke formation for support with a central hub 62 at which one end of each grid piece attaches. Again, as in FIG. 4, the dimensions of the apertures of the large mesh protecting grid must prevent the contact between fabrics and the fine mesh section. In either the woven, non-woven or other form the fine mesh section 17 essentially prevents any undissolved particles or undiluted liquid from exiting the inner chamber 23 of the hollow body during use. The grid pieces 60 protect the fine mesh section from direct contact with the surrounding fabrics being washed and provide for further dilution with wash water prior to contact with the fabrics.

As noted above, the materials that may be employed to construct the present invention include polyethylene or polypropylene, and elastomeric materials, such as rubber, polyvinyl chloride, polyurethane and plastics, mainly moldable thermoplastics that are both strong and flexible to provide for the tumbling that the doser device will undergo in the washing machine. The material of construction is preferably a resilient plastic which is sufficiently heat stable at the temperature of operation to maintain the spherical form of the device, while allowing some temporary distortions during tumbling, which facilitate dispensing of the active. The plastics which can be employed are those which can be fabricated using blowing or injection blow-molding technology. The preferred materials are chosen from polypropylenes, polycarbonates and polyethylenes, or combinations of these materials, with or without adjuvants. The hollow body is conveniently made by injection blowmolding. The dispensing closure and the protecting grid are economically made by injection molding. The fine mesh section is made of a sheet of plastic, usually the same as the hollow body, with a plurality of apertures or is a woven or non-woven fabric material. If a woven or non-woven fabric material is used, it can be a synthetic or non-synthetic. If a synthetic, it can be a polyene such as polyethylene or polypropylene, and if non-synthetic, a cellulose based material. In a further alternative, the fine mesh can be an open celled foam such as an open celled polyurethane foam. It also can be a sheet of material with a plurality of fine apertures.

It is evident from the structure of the hollow bodies of the figures that the bellows can be essentially of any size, shape and number. The hollow body would be designed to have good structural integrity and to dispense the contained substance over a given period of time. The greater the resiliency of the hollow body the greater the pumping action with a better delivery of the contained substances. The hollow bodies can be engineered for essentially any delivery rate.

The hollow body is shown as being generally spherical. However, it could be of essentially any shape from triangular, quadrangular, pentagonal, hexagonal, or greater number of sides. It also may be generally cylindrical. The only limitation is to have one or more bellows or integral part of the structure so that there can be a pumping action during usage.

In use, a person will open the dispensing closure on the hollow body and pour in a given amount of the substance to be dispensed. The dispensing closure of the hollow body then is closed and latched. The now filled hollow body is placed in the wash tub of the an automatic washing machine among the laundry to be washed and the door of the washing machine is closed and the wash cycle started. The wash tub will fill with waster to a given level. The wash tub then rotates. The rotation of the wash tub and the changing weight on the hollow body causes the hollow body to flex and to draw in and expel water. The expelled water will carry some of the dissolved and diluted substances into the wash tub. A the end of the wash cycle the hollow body is removed from the wash tub with the laundry and can be reused.

The hollow body can be used for other than in an automatic washing machine. It can be used at any time that it is desired to deliver a substance in a diluted state to a body of liquid. There can be household or industrial uses.

The foregoing description and examples illustrate selected embodiments of the present invention and in light of the description and examples, various modifications will be suggested to one skilled in the art, all of which are within the spirit and purview of this invention. The invention may be embodied in other specific forms without departing from the spirit or essential characteristics of the invention. The present embodiments are to be considered in all respects as illustrative and not restrictive.

I claim:

1. A device for the release of at least one active agent into a wash tub on contact with a liquid wash medium comprising:

a hollow body having an inner chamber, a mouth opening, and a neck between the mouth opening and the inner chamber;

means integral with said hollow body, to allow the volume of said hollow body to increase and decrease in a given range upon the application of outside forces, thereby increasing an exchange of liquid between the inner chamber of said hollow body and the liquid wash medium outside said hollow body;

a cover removably attached to said neck and closing said mouth opening;

attaching means on said neck for said cover; and a plurality of fine apertures on a part of said device whereby liquid wash medium can pass through said apertures into said hollow body to dissolve and dilute substances therein and carry out of said hollow body some of the dissolved and diluted substances, a protecting grid overlaying the plurality of fine apertures, said protective grid of a structure to protect the plurality of fine apertures from direct contact with laundry in the washer and to provide a space for further dilution of the dissolved and diluted substances prior to contact with the laundry in the wash tub.

2. A device as in claim 1, wherein said means to increase and decrease the volume of said hollow body is at least one bellow.

3. A device as in claim 2, wherein there are at least two bellows in said hollow body.

4. A device as in claim 3, wherein said apertures are a fine mesh.

5. A device as claimed in claim 4, wherein said fine mesh is woven.

6. A device as claimed in claim 4, wherein said fine mesh is non-woven.

7. A device as claimed in claim 2, wherein said cover attaches to the neck of said hollow body by an interlocking projecting rib and mating recess arrangement.

8. A device as claimed in claim 2, wherein said cover is a molded cover.

9. A device as claimed in claim 1, wherein said protecting grid has open cells.

10. A device as in claim 1, wherein said hollow body has at least one bellow, said at least one bellow extending essentially longitudinally on said hollow body.

11. A device as in claim 1, wherein said hollow body has at least one bellow said at least one bellow extending longitudinally on said hollow body.

12. A device as in claim 1, wherein said hollow body has at least one bellow said at least one bellow extending laterally around said hollow body.

13. A method of washing laundry in a wash tub comprising placing the laundry in a wash tub, placing laundry washing substances into a hollow body that has at least one bellow that allows the hollow body to change in volume and a portion having fine apertures overlayed with a protecting grid and adding water to said tub characterized in that the fine apertures of said hollow body allow wash water to be drawn into said hollow body to dissolve and dilute the substances in the hollow body and to expel dissolved and diluted substances into the wash tub, the laundry not contacting the fine apertures due to the protective grid therefore to further dilute the dissolved and diluted substances that are expelled form the hollow body prior to contact with the laundry.

14. The method as in claim 13 comprising agitating the laundry in the wash tub with the changing weight of the laundry on the hollow body causing the hollow body to flex and draw in and expel wash water.

* * * * *